United States Patent [19]

Eberle

[11] 4,214,725

[45] Jul. 29, 1980

[54] FURNITURE BASE

[75] Inventor: Gunter F. Eberle, Dallas, Tex.

[73] Assignee: Vecta Contract, Inc., Dallas, Tex.

[21] Appl. No.: 6,187

[22] Filed: Jan. 24, 1979

[51] Int. Cl.[3] ..... A47B 91/00; A47B 13/02

[52] U.S. Cl. ..... 248/188.7; D6/27; 108/150

[58] Field of Search ..... D6/31, 27, 146; 248/188.7; 108/150; 312/254

[56] References Cited

U.S. PATENT DOCUMENTS

| | | | |
|---|---|---|---|
| 3,185,423 | 5/1965 | Jones | D6/27 X |
| 3,499,625 | 3/1970 | Froedge | 248/188.7 |
| 3,570,797 | 3/1971 | Stark et al. | 248/188.7 |
| 3,705,704 | 12/1972 | Textoris | 248/188.7 |

FOREIGN PATENT DOCUMENTS

| | | | |
|---|---|---|---|
| 959035 | 12/1974 | Canada | 248/188.7 |
| 2615528 | 10/1976 | Fed. Rep. of Germany | 248/188.7 |

*Primary Examiner*—James T. McCall

[57] ABSTRACT

A furniture base for a table, chair or the like having a cast pedestal with a number of feet radially extending from a central, upwardly projecting riser. A vertical slot is cast in the riser between each of the feet and a recessed wall may be provided behind each one of the slots. An upper support member may be mounted directly on the riser or atop a center column attached to the riser. The upper support is welded onto either the center column or the riser through a collar in the support obviating the need for grinding and polishing of an exposed weld.

9 Claims, 5 Drawing Figures

FURNITURE BASE

BACKGROUND OF THE INVENTION

Furniture bases for tables and chairs, in addition to their function of solidly supporting the table or chair, must be aesthetically pleasing. Economy of manufacture is also a very important consideration.

There are a number of furniture bases presently on the market which satisfy the basic requirements of support, aesthetics, and economy of manufacture, such as the chair base shown in Patent D-194,667, as well as the round or bell bottom bases presently on the market. Such bases do not, however, have the mass and form desired by architects and designers.

A base having a plurality of feet with a constant half-round cross section and a rather abrupt but softened end would have the requisite mass and form. However, such a design would be prohibitedly expensive to manufacture. It would have abrupt changes in contour with deep corners where the feet come together making it impossible to get down into such corners with conventional mechanical grinding and polishing devices.

Eliminating the corners between the feet by means of large fillets as in D-194,667 solves the grinding problem, but the large fillets detract from the appearance of mass and form sought.

SUMMARY OF THE INVENTION

The present invention involves a furniture base for tables or chairs wherein the base has a cast pedestal with a number of feet radially extending from a centrally upwardly projecting riser, a slot is provided in the riser between each of the feet. A recessed wall may be made behind each of the slots. An upper support is secured to the riser directly or by means of a center column. The upper support is welded to the riser or column through a collar in the support to obviate any grinding or polishing to remove an exposed weld. Further objects and advantages of the present invention will become apparent as the following description proceeds, and the features of novelty that characterize the invention will be particularly pointed out in the claims annexed to and forming a part of the specification.

BRIEF DESCRIPTION OF THE DRAWINGS

For a better understanding of the present invention, reference may be had to the accompanying drawings in which.

DESCRIPTION OF THE PREFERRED EMBODIMENT

Figure 1:
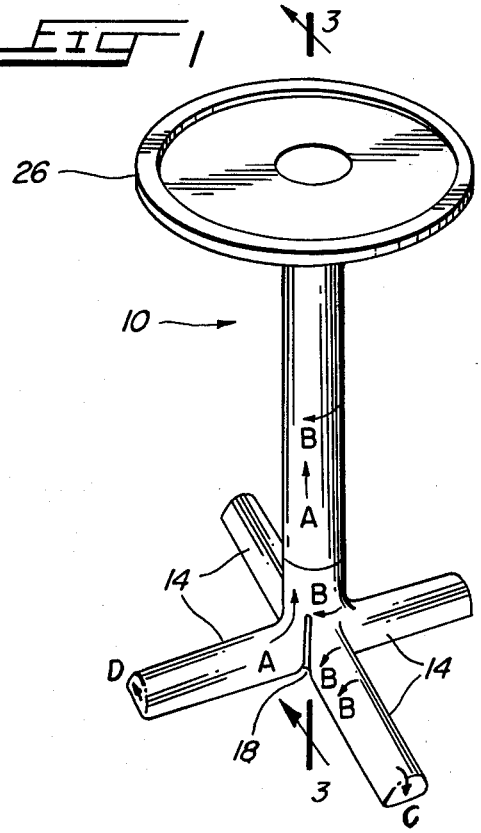
FIG. 1 is a perspective view of a furniture base embodying my invention.

Referring now to the drawings in which like parts are designated by like reference numerals in the various views, there is shown in FIG. 1 a furniture base generally designated by the reference numeral 10. The base has an integrally cast aluminum pedestal 12 with a number of feet 14 radially extending from the central, upwardly projecting riser 16. Each of the feet is cast so that the upper surface is a constant half-round in cross section. The end 15 of each of the feet has somewhat rounded corners in order to provide a rather abrupt but "softened" end.

As will be appreciated from FIG. 1, the feet 14 would form rather deep corners where they come together. However, a substantially vertical slot 18 is provided in the riser where the feet intersect. Each of the slots extend upwardly somewhat beyond the height of the feet. The slots 18 obviate the need to try and get in and polish the deep corners between the feet. As indicated on FIG. 1, because of the slots 18, it is possible to economically grind and polish the casting by means of belts run in directions A, B, C, and D.

Figure 5:
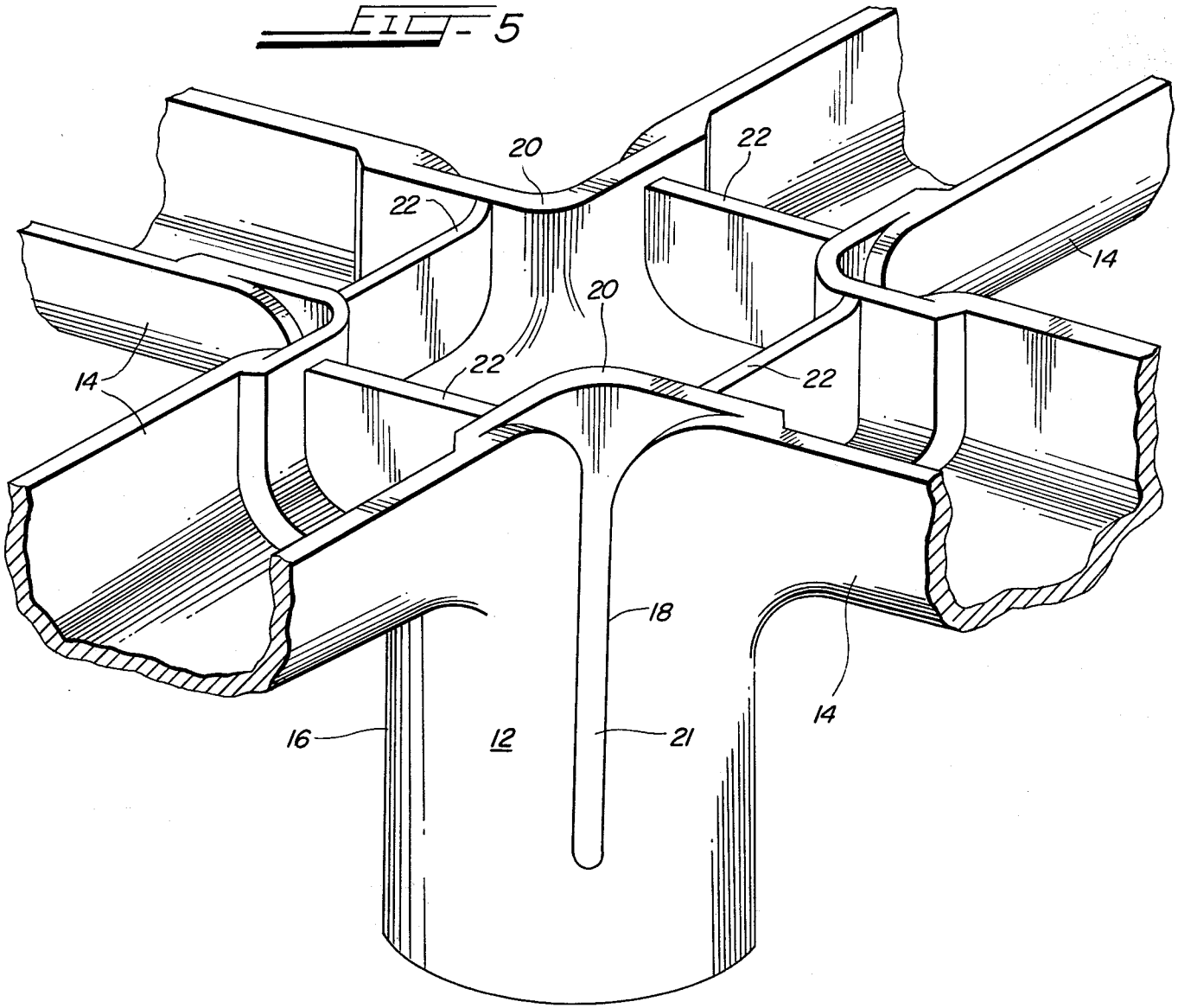
FIG. 5 is an enlarged framentary bottom perspective view of the center portion of the pedestal.

As is best shown in FIG. 5, the pedestal is also cast with a recessed wall 20 behind each of the slots 18. The wall 20 provides a surface 21 which can be left as it comes from the mold without any grinding or polishing because it is in shadow. The recessed walls 20 unite the feet, avoiding the appearance of gaps in the structure, while still providing for economical mechanical grinding and polishing of the pedestal. Transverse walls 22 may also be provided in the casting for additional structural support. Bosses 23, which may be used for the mounting of casters, glides or the like which are not shown, are also integrally cast.

The base 10 is provided with an upper support 26 that has a substantially horizontal top surface 27 for the mounting of a table top or chair seat. A plurality of strengthening ribs 28 are cast on the underside of the support 26. An internal collar 30 is provided for mounting the support on the riser. In the drawings, the support 26 is shown attached to a center column 32 which in turn is attached to the riser 16. However, as will be appreciated by those skilled in the art, the support 26 could be attached directly to the riser in the same manner as will be described with respect to the securing of the support to the center column.

Figure 3:
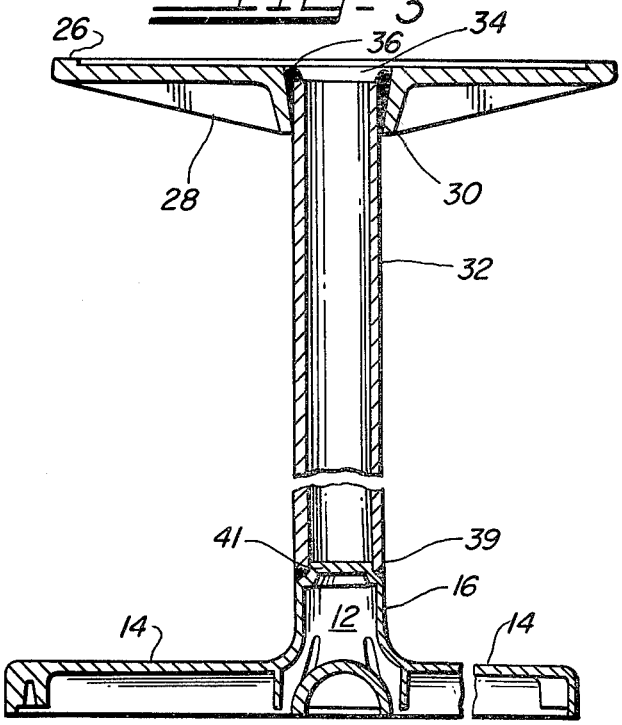
FIG. 3 is a vertical sectional view along the line 3—3 of FIG. 1.
Figure 2:
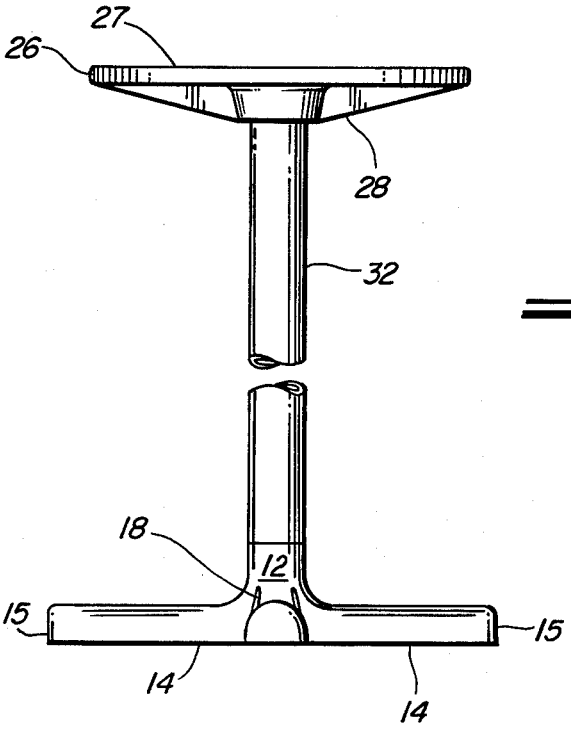
FIG. 2 is an elevational view.
Figure 4:
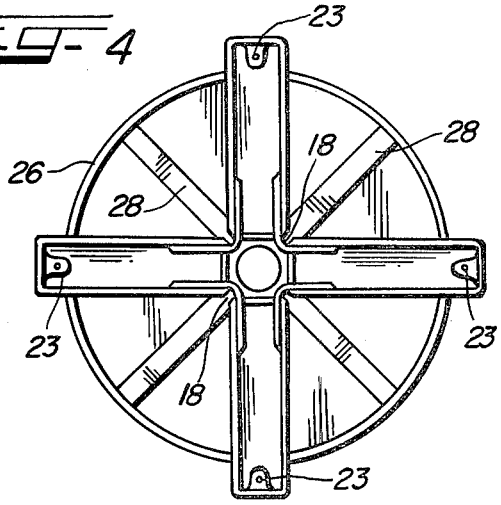
FIG. 4 is a bottom plan view.

The opening 34 of the collar 30 preferably tapers inwardly from the top, as is shown in FIG. 3. The opening 34 is of such a size that either the center column 32 or the riser 16 fits into the opening. The support is secured to the center column or riser by means of welding within the opening 34, as shown in FIG. 3. Since the weld bead 36 is contained entirely within the collar opening 24, which is in turn covered by the table top or chair seat, the need to grind and polish an exposed weld is obviated.

The lower end 39 of the column 32 is attached to the riser 16. As shown in FIG. 3, the riser can be provided with an upper necked down part 41 that would fit into the inside of the column 32. The column 32 may be an extruded piece having the same outer dimension as that of the riser 16 and is welded to the riser 16.

After the weld securing the column to the pedestal is ground down to surface, the completed base may be further ground or polished mechanically in the manner previously indicated, resulting in a brushed or polished surface finish. The base may be used with such a finish or it may be coated with a thermoset or thermoplastic colored finish.

While a specific embodiment of the present invention has been shown and described, it will be apparent to those skilled in the art that various changes and modifications may be made without departing from the invention in its broader aspects, and it is, therefore, contemplated in the appended claims to cover all such changes and modifications as fall within the true spirit and scope of the present invention.

What is claimed as new and desired to be secured by United States Letters Patent is:

1. A furniture base comprising a cast pedestal having substantially horizontal feet radially extending from a central upwardly projecting riser, a plurality of substantially vertical open slots in said riser, each one of said slots disposed between respective ones of said feet, and an upper support mounted on said riser.

2. A furniture base, as defined in claim 1, wherein said pedestal has a recessed wall behind each of said slots for substantially the entire length of the slot.

3. A furniture base, as defined in claim 2, wherein said recessed wall is integrally cast.

4. A furniture base, as defined in claim 1, wherein said riser is cylindrical, and each of said feet comprises a substantially half-round cross section extending substantially from the outer end of the foot to said riser with a smooth fillet between the intersection of each of said feet and said riser.

5. A furniture base, as defined in claim 1, including a center column, said support is mounted on said riser by means of said column, one end of said column being attached to said riser, and said support being secured to the other end of said column.

6. A furniture base, as defined in claim 5, wherein said support contains a tubular open ended collar, said other end of said column fitting into said collar, and fastening means securing said support onto said column applied through said collar opening.

7. A furniture base, as defined in claim 6, wherein said fastening means comprises welding said support onto said column entirely within said collar.

8. A furniture, as defined in claim 1, wherein said support contains a collar, said riser fitting into said collar, and fastening means securing said support onto said column applied through said collar opening.

9. A furniture base, as defined in claim 8, wherein said fastening means comprises welding said support onto said riser entirely within said collar.

* * * * *